US007908682B2

(12) United States Patent
Sullivan

(10) Patent No.: US 7,908,682 B2
(45) Date of Patent: Mar. 22, 2011

(54) FIBERGLASS SWIMMING POOL SHELL HAVING PRE-FORMED SOCKETS TO ATTACH MISCELLANEOUS ITEMS

(75) Inventor: Kirk Sullivan, Lakeland, FL (US)

(73) Assignee: San Juan Patents, Inc., Lakeland, FL (US)

( * ) Notice: Subject to any disclaimer, the term of this patent is extended or adjusted under 35 U.S.C. 154(b) by 1137 days.

(21) Appl. No.: 11/325,367

(22) Filed: Jan. 4, 2006

(65) Prior Publication Data

US 2007/0151015 A1 Jul. 5, 2007

(51) Int. Cl.
*E04H 4/00* (2006.01)

(52) U.S. Cl. ..... 4/496; 4/494

(58) Field of Classification Search ..... 4/494, 496
See application file for complete search history.

(56) References Cited

U.S. PATENT DOCUMENTS 3,065,820 A * 11/1962 Prizler et al. ..... 182/93
3,665,523 A 5/1972 Chase
3,823,426 A 7/1974 Mitchko
3,868,732 A 3/1975 Engelhart
4,060,946 A * 12/1977 Lang et al. ..... 52/169.7
4,346,885 A 8/1982 Mathou
4,592,100 A 6/1986 Robertson et al.
5,014,370 A * 5/1991 Stark, Sr. ..... 4/505
5,040,251 A * 8/1991 Hanford ..... 4/496
5,103,607 A * 4/1992 Bard ..... 52/169.5
5,316,315 A 5/1994 Roark, Jr.
5,524,399 A 6/1996 Reum et al.
5,644,873 A 7/1997 Bourgault
5,826,855 A * 10/1998 Dick ..... 251/144
6,209,147 B1 4/2001 Wheaton
6,408,577 B1 6/2002 Desjoyaux et al.
6,571,403 B2 6/2003 Wheaton

* cited by examiner

*Primary Examiner* — Khoa D Huynh
*Assistant Examiner* — Karen Younkins
(74) *Attorney, Agent, or Firm* — Stetina Brunda Garred & Brucker

(57) ABSTRACT

A pool shell molding system that enables accessories such as tables, chairs, parasols, basketball rims, and volleyball nets to be selectively and easily attached and removed. The pre-formed mold includes a recessed section with an outer edge that contacts and grips the various pool accessories. The depth of the recess is reduced by including a lip section extending from the bottom of the pool accessory, forming a contact and seal with the pool shell. Additionally, the pre-formed mold also includes an extended section with an outer edge that contacts and is gripped by the various pool accessories. The pre-formed mold can also secure a pole structure that includes a pole and a base member attached to the pole that facilitates a flexing locking relationship with the pool surface.

6 Claims, 3 Drawing Sheets

FIBERGLASS SWIMMING POOL SHELL HAVING PRE-FORMED SOCKETS TO ATTACH MISCELLANEOUS ITEMS

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

1. Technical Field

The present invention generally relates to swimming pools. More particularly, the present invention relates to fiberglass swimming pools having preformed structures and sockets for securing various items underwater.

2. Related Art

Prefabricated fiberglass swimming pools are well-known in the art. Such pools generally consist of molded, one piece structures that rest within an excavated portion of ground, the latter defining an excavated floor that is compacted, typically with sand and water, and graded to the contours of the pool. Typically, once set into place the fiberglass pool is filled with water while construction sand is water-compacted around the outside of the pool to lock the pool into position. Thereafter, a coping is formed on the outer periphery of the pool and electrical connections and plumbing for heating and filtering are installed.

Advantageously, fiberglass pools have the ability to flex without loosing strength, which is especially important in areas where the ground may have a tendency to shift. Moreover, fiberglass pools are approximately seventeen times stronger than concrete, with a tensile strength of approximately 11,300 pounds per square inch. As a consequence, such flexibility allows the pool to expand and contract with the earth without being damaged. Moreover, because the tile trim affixed about the periphery of the pool is typically secured via a silicone adhesive silicone grout, such tile will also flex with the pool and thus remain more durably attached, unlike tile trim affixed to conventional concrete pools. Moreover, because silicone grout is utilized, the same is thus impervious to stains and algae growth. In fact, it is well-documented that the installation of a fiberglass pool is substantially easier and less time consuming versus the time it takes to construct and outfit a conventional concrete pool. Exemplary of such fiberglass pools include those pools produced by San Juan Products, Inc. of Lakeland, Fla.

Despite their numerous advantages, however, fiberglass pools have the drawback of not allowing for customized structures to be affixed thereto. Along these lines, because a fiberglass pool is generally formed as a unitary, molded structure, the same does not accommodate additional structures, such as benches, stools, or other like structures commonly integrated as part of a given pool's design. Along these lines, by virtue of the manufacturing process for forming fiberglass pools, such structures would necessarily have to be integrated as part of the molding process, which as a consequence would substantially complicate and add to the cost associated with manufacturing fiberglass pools. As such, consumers are often limited as to what additional options they can incorporate as part of their fiberglass pool, and thus cannot incorporate additional seats, stools, and the like that may be desired for a given customer. These same concerns apply with respect to sporting devices commonly integrated with pools, such as volleyball nets and basketball hoops. In this regard, there is typically no way to easily incorporate such structures without permanently affixing such structures in or around the swimming pool.

As such, there is a substantial need in the art for a system that can enable additional structures to be readily attached to and integrated with a fiberglass pool. There is additionally a need in the art for such a system that is of exceedingly simple construction, exceptionally durable, and can provide substantial options to pool purchasers while minimizing complications associated with the fiberglass pool manufacturing process.

BRIEF SUMMARY

In light of the foregoing limitations, the present invention was conceived. Provided is a fiberglass pool accessory system having a bottom pool surface, a side pool surface, and an outer pool edge. Further, one or more selectively attachable pool fixtures having a base defined by an inner base surface and an outer base surface are provided, as well as one or more preformed moldings on the bottom pool surface which is configured to interface with the base. The pool fixture may be a stool, a table, or any other accessory typically used in pools. In accordance with an aspect of the present invention, there is a cover configured to interface with the preformed molding and forming a continuous surface over the same.

In accordance with another aspect of the present invention, the preformed molding is a recess having a recess center, a bottom recess surface, a vertical edge surface defining an edge of the recess and matching the outline of the base. The vertical edge surface is in contact with and grips the outer base surface. Additionally, the base includes a lip member extending laterally and having a top lip surface that is coplanar with the bottom pool surface and a bottom lip surface that contacts the bottom recess surface. The lip member extends from the inner base surface towards the recess center, thereby forming a contact and a gripping relationship with the outer base surface. In accordance with another aspect of the invention, the lip member extends from the outer base surface away from the recess center, and the vertical edge surface is in contact with and grips the lip member.

According to yet another aspect of the present invention, the preformed molding is an extrusion having an extrusion top surface and a vertical edge surface defining an edge of the extrusion. The edge generally matches the outline of the base, and the inner base surface is in contact with and grips the vertical edge surface.

In accordance with still another aspect of the present invention, the preformed molding is a groove having an interior groove surface and an exterior groove surface. The inner base surface is in a sliding relationship with the interior groove surface, and the outer base surface is in a sliding relationship with the exterior groove surface.

Finally, according to another aspect of the present invention, the pool fixture is a vertically elongate pole structure. The preformed molding is a recess defined by a first recess side surface, a recess bottom surface, and a locking recess side surface. The vertically elongate pole structure includes a pole, which can be a part of a volleyball net, a basketball backboard/rim, or the like, and a base member cooperating with the locking recess side surface to lock the vertically elongate pole structure within the recess.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The detailed description set forth below in connection with the appended drawings is intended as a description of the presently preferred embodiment of the invention, and is not intended to represent the only form in which the present invention may be constructed or utilized. The description sets forth the functions and the sequence of steps for developing and operating the invention in connection with the illustrated embodiment. It is to be understood, however, that the same or equivalent functions and sequences may be accomplished by different embodiments that are also intended to be encompassed within the spirit and scope of the invention.

Figure 1:
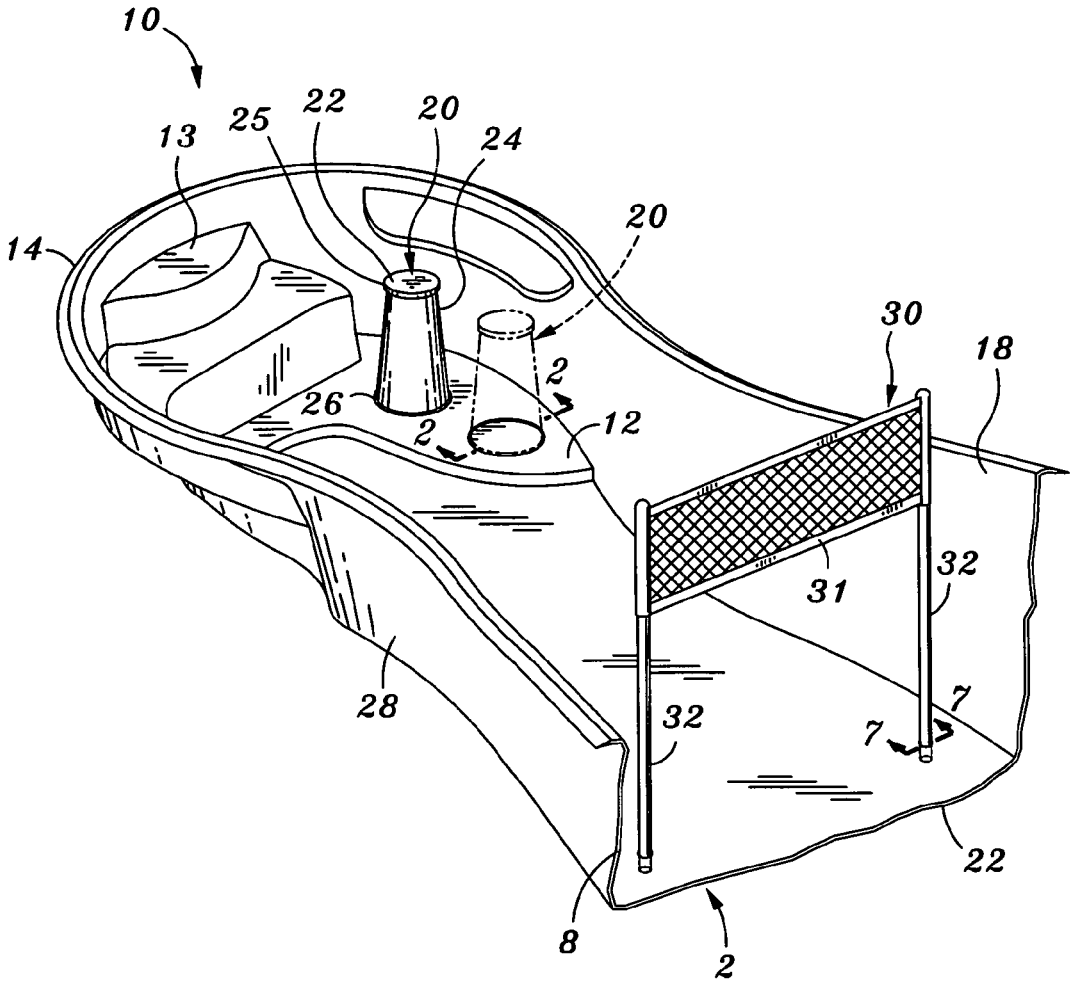
FIG. 1 is a perspective view of a molded fiberglass pool in accordance with one aspect of the present invention.

With reference to FIG. 1, pool shell 10 is defined by side wall 8 having an inner side wall surface 18 and an outer side wall surface 28, bottom wall 2 having an inner bottom surface 12 and an outer bottom surface 22, and outer edge 14. The profile of pool shell 10 is generally defined by the contour of outer edge 14, where side wall 8 extends downward therefrom, terminating at bottom wall 2. Side wall 8 is in a substantially perpendicular relationship to bottom wall 2, but may be angled otherwise. Outer side wall surface 28 generally follows the contour of inner side wall surface 18, and inner bottom wall surface 12 generally follows the contour of outer side wall surface 22. As a person having ordinary skill in the art will recognize, however, the configuration of side wall 8 may be altered by additional features molded thereon, such as molded stairs 13, which is provided as an example only and not of limitation. Such person will also recognize that the contour of side wall 8, outer edge 14, and bottom wall 2 is not limited in any way; pool shell 10 need only be a basin capable of holding water. Other shapes of outer edge 14 include rectangular configurations, square configurations, circular configurations, and so forth, and can include additional abutments formed thereon. The pool shell 10 is constructed of fiberglass by way of a single molding with techniques well known in the art.

Still referring to FIG. 1, there are shown various aquatic accessories attached to bottom wall 2, such as stool 20 and volleyball net 30. Other accessories may be variously attached as taught by the present invention, however, and the aforementioned implements are by way of example only and not of limitation.

Stool 20 is comprised of a seating surface 22 and a side wall 24. Side wall 28 wraps about the circumference of seating surface 22, and has a seating attachment end 25 and a pool surface attachment end 26, and the interior of stool 22 is accordingly hollow. Stool 22 may be constructed of any semi-rigid material such as plastic, or fiberglass to match the material of pool shell 10. Generally, pool surface attachment end 26 has a larger circumference than seating attachment end 25, wherein stool 22 has a generally conical configuration. However, pool surface attachment end 26 may also have the same circumference as the seating attachment end 25, resulting in a cylindrically configured stool 20.

With reference to the various embodiments shown in FIGS. 2 through 6, in which cross sectional views along 2-2 of FIG. 1 are shown, the details of the stool attachment mechanism will be discussed in further detail hereunder.

Figure 2A:
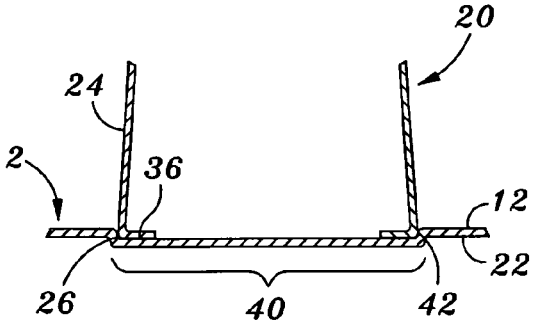
FIGS. 2*a* and 2*b* are cross sectional views of a first embodiment in accordance with the teachings of the present invention.
Figure 2B:
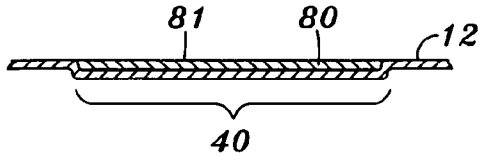

Referring specifically to FIG. 2*a*, depicted is one embodiment according to an aspect of the present invention. Bottom wall 2 is comprised of inner bottom wall surface 12 and outer bottom wall surface 22. Further, bottom wall 2 has a recessed portion 40 having a diameter substantially equal to the diameter across side wall 24 of stool 20 at surface attachment end 26. Stool 20 additionally has a lip section 36 extending inwardly toward the center of stool 20 from surface attachment end 26 of side wall 24. Lip section 36 extends in a generally parallel relationship to inner bottom wall surface 12, particularly in recessed portion 40, in order to facilitate a frictional seal therebetween that can be adhesively secured. The depth of recessed portion 40 is substantially equal to the height of lip section 36. This configuration permits a recessed portion 40 having lesser depth, since the greater contact surface area provided by lip section 36 reduces the need for lateral compressive forces from recess edge 42 in order to support stool 20. As illustrated in FIG. 2*b*, when not in use cover 80 forms a surface 81 coplanar with inner bottom wall surface 12 so as to prevent injuries resulting from feet or other bodily appendages becoming lodged within recess 40.

Figure 3A:
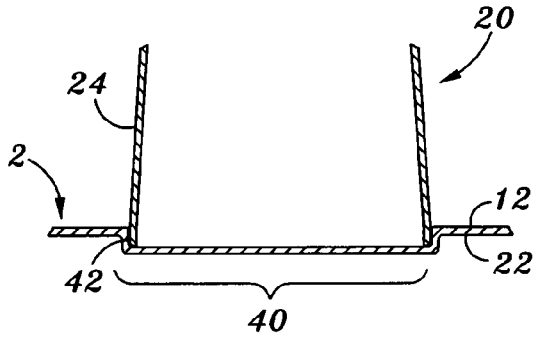
FIGS. 3*a* and 3*b* are cross sectional views of a second embodiment in accordance with the teachings of the present invention.
Figure 3B:
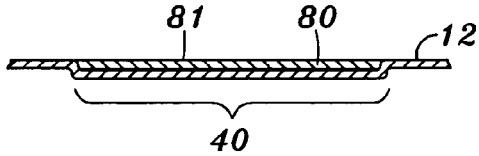

Referring now to FIG. 3*a*, a recessed portion 40 on bottom wall 2 holds and supports stool 20. The compressive forces of recess edge 42 which may be adhesively attached to sidewall 24 to improve the grip of side wall 24 of stool 20, and eliminate the need for any inwardly laterally extending structure such as lip section 36 in the first embodiment as illustrated in FIG. 2. As shown in FIG. 3*b*, when no stool is being secured to bottom surface 2, cover 80 may be placed thereon to maintain a surface 81 coplanar with inner bottom wall surface 12.

Figure 4A:
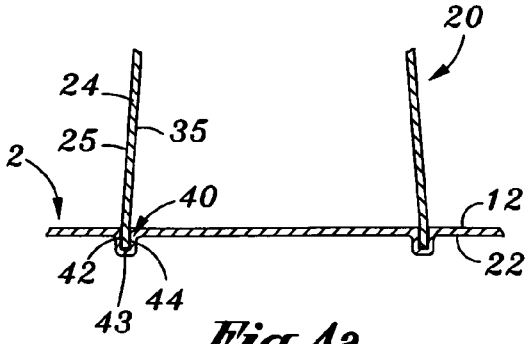
FIGS. 4*a* and 4*b* are cross sectional views of a third embodiment in accordance with the teachings of the present invention.
Figure 4B:
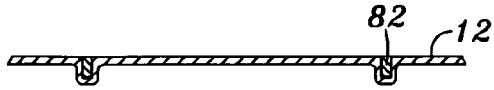

Referring to FIG. 4*a*, a third embodiment of the present invention is shown. As in the aforementioned embodiments, bottom wall 2 is comprised of an inner bottom wall surface 12 and an outer bottom wall surface 22. Stool 20 is supported and secured by a slot 40 having a contour matching that of side wall 24 of stool 20. Slot 40 is defined by an outer slot side surface 42, inner slot side surface 44, and a bottom slot surface 43. The compressive forces inherent in inner slot side surface 44 and outer slot side surface 42 grip inner side wall surface 35 and outer side surface 25 of side wall 24 of stool 20, respectively, and prevents the lateral movement of stool 20. To secure such attachment, an adhesive can be used to anchor sidewall 24 within slot 40. Along these lines and by way of example only and not of limitation, slot 40 extends beyond the thickness of bottom wall 2, and forms an extrusion from bottom wall surface 22. However, slot 40 may extend to any depth, so long as it is capable of securing side wall 24 of stool 20. When there are no stools secured to bottom wall 2, as shown in FIG. 4*b*, a ring-like cover structure 82 may be placed on 40.

Figure 5:
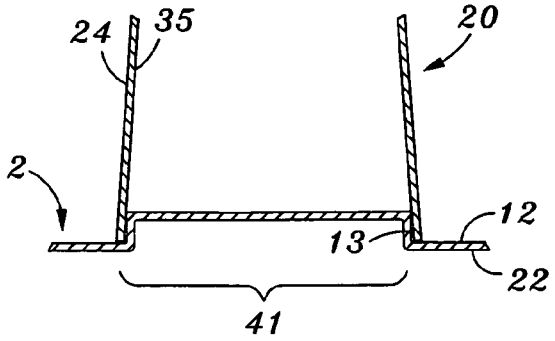
FIG. 5 is a cross sectional view of a fourth embodiment in accordance with the teachings of the present invention.

Referring now to FIG. 5, a fourth embodiment of the present invention is shown. Bottom wall 2 is comprised of an inner bottom wall surface 12 and an outer bottom wall surface 22. Raised section 41 provides a support structure to secure stool 20 in place, and side wall 24 having an inner side wall surface 35 grips the vertically extending section 13 of inner bottom wall surface 12, which may be fastened via the use of an adhesive. Side wall 24 is constructed to have a slightly smaller diameter while retaining its capability of fitting over extruded section 41 so that the compressive forces of side wall 24 of stool 20 enable a gripping relationship with vertical extrusion section 13 of inner bottom wall surface 12.

Figure 6A:
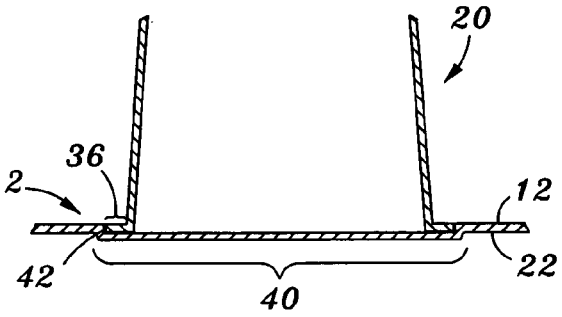
FIGS. 6*a* and 6*b* are cross sectional views of a fifth embodiment in accordance with the teachings of the present invention.
Figure 6B:
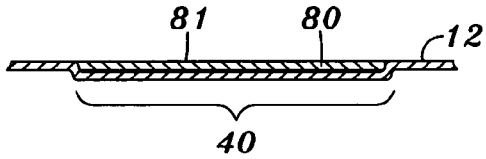

Referring now to FIG. 6*a*, a fifth embodiment of the present invention is shown. Bottom wall 2 is comprised of an inner bottom wall surface 12 and an outer bottom wall surface 22. Recessed section 40 effectively secures stool 20 in place, with the expansion force of outwardly extending lip section 36 cooperating with the retaining force of recessed section 40 as exerted through recess edge 42. Again, an adhesive can optionally be utilized to secure such interconnection. The height of outwardly extending lip section 36 is substantially equal to the depth of recessed section 40. As illustrated in the first embodiment, the horizontal surface of outwardly extending lip section 36 forms a seal to inner bottom surface 12, requiring less vertical contact surface area as provided by recess edge 42. As depicted in FIG. 6*b*, a cover 80 may be placed on recessed section 40.

As can be appreciated by a person having ordinary skill in the art, the first, second, fourth, and fifth embodiments requires a simpler molding construction as compared to the third embodiment. On the other hand, the holding strength of the third embodiment is relatively higher than that of the first, second, and fifth embodiments. Varying structures that strike various balances between holding strength and molding simplicity are understood to be encompassed within the teaching of the present invention, and the above embodiments are provided by way of examples rather than of limitation.

Referring back to FIG. 1, volleyball net 30 is shown, comprising a net section 31 and two poles 32. While a volleyball net is provided, it is by way of example only and not of limitation, and any other structure having one or more poles or pole-like structures may be substituted. For example, a basketball backboard/rim/net apparatus may be used. Another example is a parasol for providing shading for pool users.

Figure 7A:
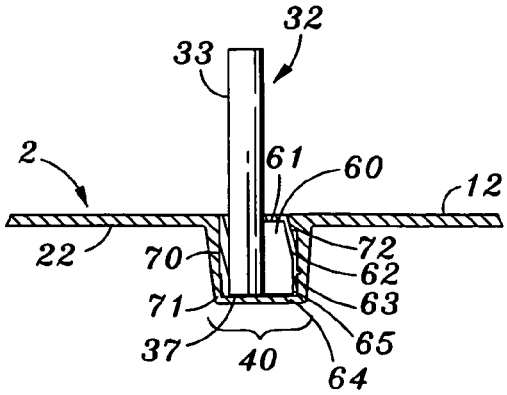
FIGS. 7*a* and 7*b* are cross sectional views of a sixth embodiment in accordance with the teachings of the present invention.
Figure 7B:
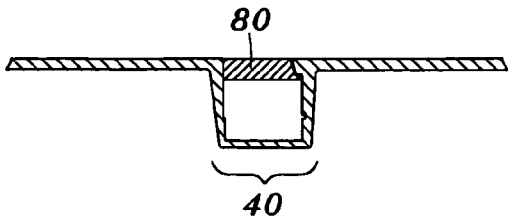

With reference now to FIG. 7*a*, a sixth embodiment of the present invention is illustrated as a cross section viewed from axis 7-7 of FIG. 1. Bottom wall 2 is comprised of inner bottom wall surface 12 and outer bottom wall surface 22. Pole structure 32 is comprised of vertically elongated pole 33 having a bottom end 37 and a laterally disposed base 60 attached thereon. Base 60 is further defined by a top surface 61, angularly offset side surface 62, vertical side surface 63, bottom surface 64, and pole attachment surface 65, which is attached to vertically elongated pole 33. Bottom wall 2 secures pole structure 32 by a recess 40 formed on the same. The exterior of recess 40 is defined by outer bottom wall surface 22. The interior of recess 40 is defined by a first side surface 70, a bottom surface 71, a second side surface 72, and an angled latching surface 72. When pole structure 32 is placed within recess 40, bottom end 37 of vertically elongated pole 33 and bottom surface 65 of base 60 contacts bottom surface 70 of the interior of recess 40. Additionally, angled latching surface 72 prevents casual removal of pole structure 32 by preventing vertical movement against angularly offset side surface 62 and vertical side surface 63. However, deliberate removal is accomplished by the flexing of angled latching surface 72 to enable the same. As pole structure 32 is pulled upward, angularly offset side surface 62 is pressed against angled latching surface 72, causing the same to bend, thereby permitting the remainder of base 60 to slide past. When no pole structure 32 is placed within recess 40, a cover 80 as shown in FIG. 7*b* is placed within recess 40.

The above description is given by way of example, and not of limitation. Given the above disclosure, one skilled in the art could devise variations that are within the scope and spirit of the invention disclosed herein. For example, any of a variety of fastening means known in the art, such as clamps, locks, latches, and/or various types of bonding compositions may be utilized to facilitate and secure attachment. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A fiberglass pool accessory system having a bottom pool surface, a side pool surface, and an outer pool edge, comprising:

a. one or more selectively attachable pool fixtures having a base defined by an inner base surface and an outer base surface, wherein said base further includes a lip member extending laterally and having a top lip surface and a bottom lip surface; and b. at least one molding integrally formed upon and defining a portion of said bottom pool surface configured to matingly interconnect with said base wherein said at least one molding is a recess having a recess center, a bottom recess surface, a vertical edge surface defining an edge of said recess matching an outline of said base; and c. wherein said base is supported upon said bottom pool surface and is inextensible through said bottom pool surface, wherein said lip member extends from said inner base surface towards said recess center, and said vertical edge surface is in contact with and grips said outer base surface.

2. The fiberglass pool accessory system as set forth in claim 1, further comprising a cover configured to interface with said at least one molding and form a continuous surface over said at least one molding.

3. The fiberglass pool accessory system as set forth in claim 1, wherein said one or more selectively attachable pool fixtures is a stool.

4. The fiberglass pool accessory system as set forth in claim 1, wherein said one or more selectively attachable pool fixtures is a table.

5. The fiberglass pool accessory system as set forth in claim 1, wherein said top lip surface is in a coplanar relationship with said bottom pool surface.

6. The fiberglass pool accessory system as set forth in claim 1, wherein said bottom lip surface contacts said bottom recess surface.

* * * * *